United States Patent [19]

Vorbach

[11] 4,152,917

[45] May 8, 1979

[54] HOT ROLLING PILGER MILL

[75] Inventor: Emil Vorbach, Mönchen-Gladbach, Fed. Rep. of Germany

[73] Assignee: Mannesmann Aktiengesellschaft, Düsseldorf, Fed. Rep. of Germany

[21] Appl. No.: 886,539

[22] Filed: Mar. 14, 1978

[30] Foreign Application Priority Data

Mar. 15, 1977 [DE] Fed. Rep. of Germany ..... 2712061

[51] Int. Cl.[2] ..... B21B 21/00

[52] U.S. Cl. ..... 72/189; 72/252

[58] Field of Search ..... 72/189, 240, 252

[56] References Cited

U.S. PATENT DOCUMENTS

| | | | |
|---|---|---|---|
| 741,301 | 10/1903 | Briede | 72/189 |
| 1,429,061 | 9/1922 | Coe | 72/240 |
| 1,810,698 | 6/1931 | Diescher | 72/189 |
| 2,005,657 | 6/1935 | Ludwig | 72/240 |
| 2,691,907 | 10/1954 | Friedman | 72/189 |
| 3,478,557 | 11/1969 | Tremblay | 72/189 |

*Primary Examiner*—Lowell A. Larson

*Attorney, Agent, or Firm*—Smyth, Pavitt, Siegemund, Jones & Martella

[57] ABSTRACT

The pilger rolls are driven through gear segments which are reciprocated by a crank and linkage which also reciprocates the feed mechanism; that mechanism includes a carriage and a mandrel holder in a feed slide on the carriage, the mandrel holder may also reciprocate on the carriage for purposes of compensation speed differentials. The upper roll is mounted to permit lifting for venting, but the gearing remains engaged so that subsequently a new adjustment is not needed.

10 Claims, 3 Drawing Figures

HOT ROLLING PILGER MILL

BACKGROUND OF THE INVENTION

The present invention relates to a pilger type hot rolling mill and to improvements for such a mill.

A rolling mill of the pilger type is usually comprised of a fixed frame and stand supporting bearing blocks or roll mounts which can be displaced transversely to the direction and axis of rolling. A pair of pilger type rolls are journalled in these blocks or mounts and the rolls carry pinions meshing a gear element in driving engagement, particularly for imparting oscillating movement upon the rolls. The gear elements are being driven from a main drive. A feeder is disposed in the line of rolling and includes a longitudinally movable carriage or slide on which is mounted the mandrel rod holder and other equipment.

A rolling mill of the type outlined above is, for example, disclosed in German Pat. No. 938,182. This particular mill is provided with gear racks supported by the frame stand and meshing the pinions. The racks are driven by the main drive via a crank. This particular mill is designed for cold pilger rolling; its particular advantage is to be seen in coupling of the motion of rolls and feeder carriage by means of extending the rack. This type of construction, however, is not suitable for hot pilger rolling, because the rolls have to be vented so that the completed tube with mandrel can be pulled off the mandrel rod.

DESCRIPTION OF THE INVENTION

It is an object of the present invention to improve rolling mills of the pilger type in that the concept of coupled motion of rolls and feed mechanism and its carriage is maintained but to provide for a construction which permits venting of the rolls during hot rolling.

It is another object of the present invention to compensate the deviations of the linear speed of the rolls, due to the particular contour of pilger type rolls, on one hand, and the movement of the feed mechanism holding the blank, on the other hand.

Is is a particular object of the present invention to particularly control the feeder movement during pilger rolling.

In accordance with the preferred embodiment of the present invention, it is suggested to provide gear segments on the bearing blocks or roll mounts which journal the rolls. These segments, preferably having internal gearing, mesh with pinions on the rolls for driving them. The segments themselves are rotationally reciprocated, i.e. oscillated, by means of a crank driven rod linkage to which is also linked the feeder mechanism and its carriage for advancing and retracting the latter in synchronism with the rolling operation.

In addition, the mandrel rod is displaceably, i.e. resiliently, yieldingly, or actively movably positioned on the feeder carriage to compensate differences between carriage movements and linear roll speed as it affects the hollow blank being rolled. The displacement of the mandrel rod may either by the result of resilient balance as between spring means and the force exerted on the mandrel rod during rolling or the displacement may be actively established, e.g. through hydraulics, particularly for changing the end positions of the mandrel rod between reversals to thereby compensate the aforementioned speed differences.

The inventive pilger rolling mill has the advantage that the upper roll, through displaceable bearing blocks and roll mounts, can be lifted for venting, but driving engagement is maintained, so that upon restoring the upper roll to its operating position, the phase of the position of drive and roll(s) is also restored. This way, one can regularly hot pilger roll with stepwise advanced mandrel rod. The rolls maintain their exact relative position relation even while the finished tube is replaced by a new blank and the rolls are vented.

Unlike conventional hot pilger rolling, the rolls engage the blank on each pass at small speed but in synchronism as between the roll motion and the linear movement of the blank, right upon reversal of both. Knocks or impacts being usually observed during pilger rolling, are avoided. This includes particularly also the first pass. Feeder acceleration and charging it with feed advance power by rolls running at constant speed, is avoided. Thus, one can use a smaller, i.e. lower power main drive which is of even greater advantage for larger and heavier hollow blanks. The stepwise feed advance is a more uniform one so that one does not need any more a safety distance as regards the (presumed) largest possible advance per pilger stroke and pass. The frequency of the pilger oscillations (stroke rate) can be increased to thereby reduce the period of time it takes to roll a particular blank. This aspect is not only important from an economics point of view, but the technology of rolling and its dependency upon temperature of the blank is improved.

The segments are preferably coupled to a main drive by means of crank drive rod linkage. The feed mechanism carriage is likewise linked to that crank by means of a rocking arm and at an adjustable point thereon. The adjustment may be provided to compensate, e.g. wear of the rolls, but remains constant once established. Alternatively, the linkage between feed mechanism carriage and rocking arm may vary dynamically during rolling to compensate the difference between linear roll speed and the blank. However, the earlier mentioned compensation of this speed difference by means of longitudinal displacement of the mandrel holder is preferred.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIGS. 1 and 2 show a rolling mill stand and frame 1, and pilger rolls 2 and 3 being suitably journalled in insertable bearing blocks or roll mounts 12, 12' (for roll 2) and 13, 13' (for roll 3). FIG. 1 shows further a reciprocating carriage 4 or slide on a glide or slide bed 5. A main drive 6 is provided as prime mover and drives a crank 7, which, in turn, moves the carriage 4 and causes the rolls to rotate in a manner to be described below. A hollow billet or blank 8 being rolled presently is disposed on a cylindrical mandrel rod 9 and is held between the rolls accordingly. Rod 9 is supported in a lock 11 of a mandrel rod holder and receiver 10 which is indirectly mounted on the carriage 4. Holder 10 is actually directly mounted on a feed slide 35 which slides on a bed 37 which, in turn, is the immediate slide element for carriage 4, as bed 37 slides on bed 5.

Figure 1:
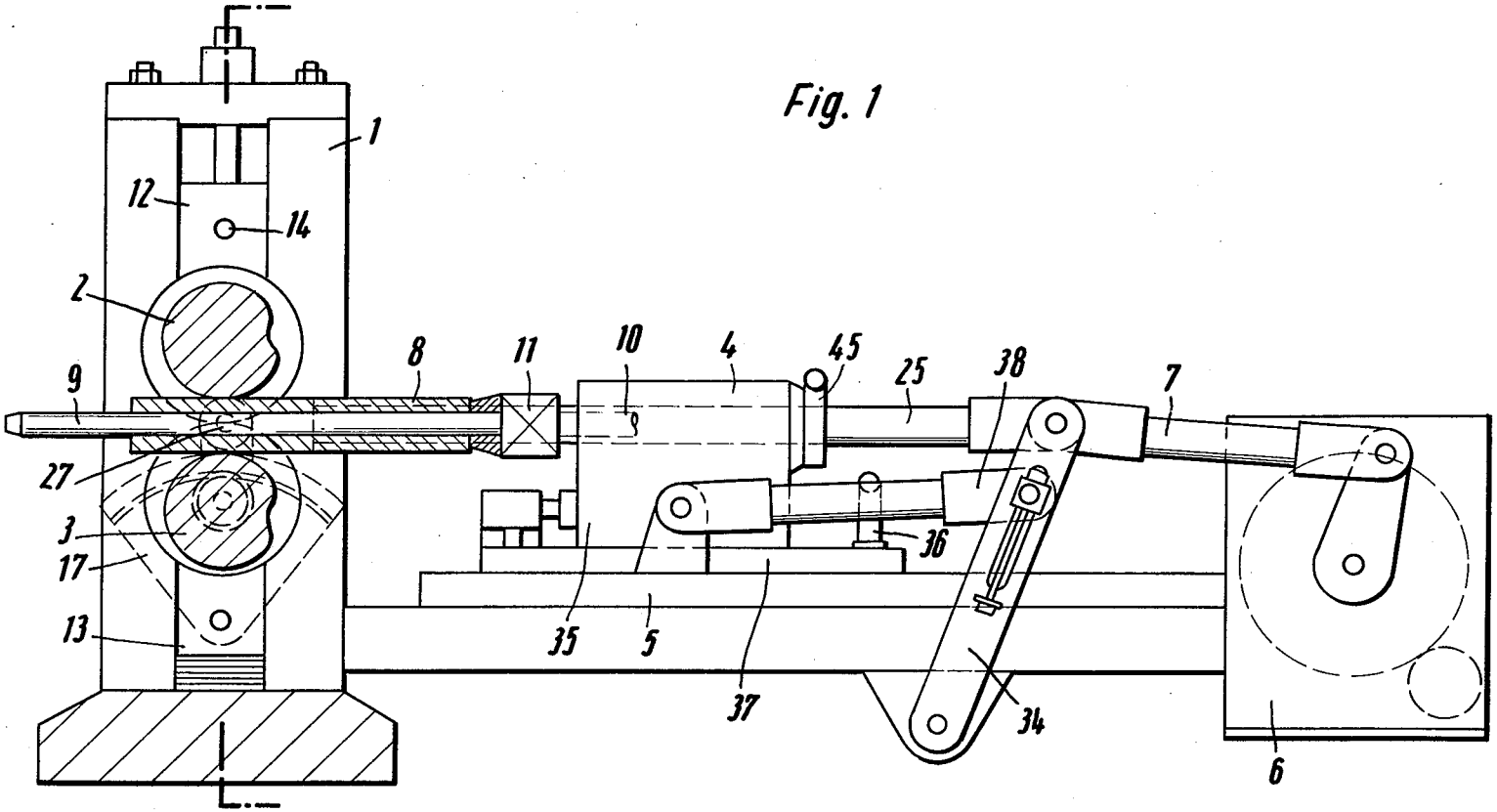
FIG. 1 is a side view, partially in section of a pilger rolling mill improved in accordance with the preferred embodiment.
Figure 2:
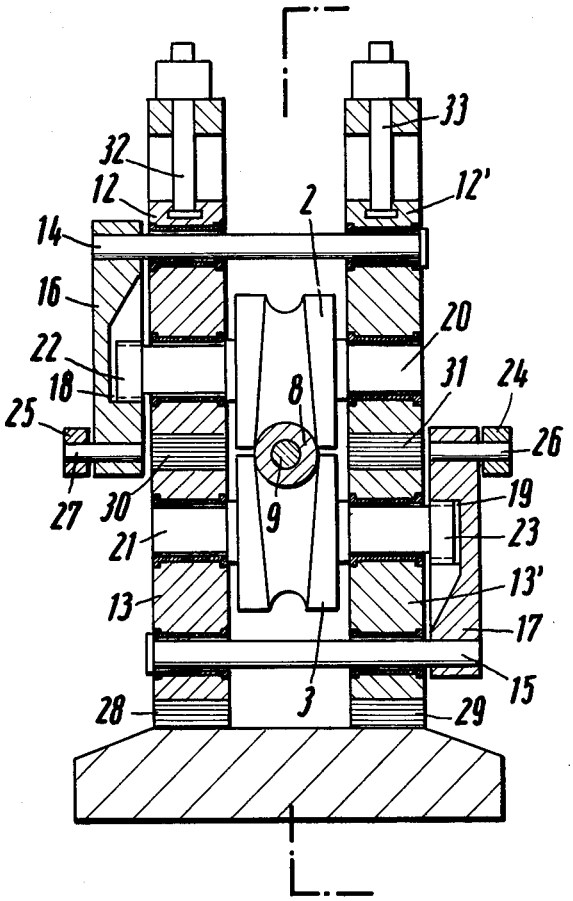
FIG. 2 is a cross-section through the mill stand along lines 2—2 in FIG. 1.

The roll mounts 12, 12', together, journal additionally an axle 14, and mounts 13, 13' journal an axle 15. Gear segments 16 and 17 are respectively mounted on the axles 14 and 15, and thus, turn also on the roll mounts. These segments have internal, i.e. radially inward directed gear tracks, 18 and 19, which respectively mesh pinions 22 and 23. These pinions, in turn, are mounted on the roll shafts 20 and 21, respectively. Thus, upon rotary pivoting of the segments 16, 17 about the respective axes of axles 14, 15, the rolls 2 and 3 are driven accordingly. Of course, axles 14 and 15 do not align with the roll shafts 20, 21.

The segments 16 and 17 are provided with pins 27 and 26, respectively, for pivotally linking rods to the segments; rod 24 at pin 26 and rod 25 at pin 27. These rods 24, 25 have their other ends connected to a rocking arm or swivel 34 which, in turn, is operated by the crank 7. Thus, as drive 6 turns the crank, rods 24, 25 move back and forth thereby pivoting segments 16 and 17 back and forth and the two rolls undergo oscillatory motion accordingly.

The segments 16, 17 could be replaced by geared racks held pivotally on the arms 24 and 25, whereby particularly the rack for meshing the pinion 22 for the upper roll must engage that pinion from above. If the pins 26 and 27 are placed differently in that they never align, one could provide for gearing for each roll to both sides, one would need four crank driven rods in that case.

Turning now to the particulars of mounting the bearing blocks and roll mounts 12, etc., the lower roll 3 is adjusted to the rolling position and dimension of the hollow 8 by means of shims 28, 29, the latter establishing a particular level for the roll mounts 13, 13' to thereby orient and center the contour of the roll groove to the mandrel rod 9. Shims 30 and 31, respectively, position the mounts 12 and 12' for matchingly positioning the upper roll 2. Shims 30 and 31 establish also the connection between lower mounts 13, 13' and upper mounts 12, 12'. The mounts 12 and 12' are, in addition, held and positioned by lifting devices 32 and 33, which can lift mounts 12, 12', respectively, off the lower mounts to thereby move the upper roll away from the lower roll for venting.

As far as the carriage or slide 4 is concerned, its lower part 37 is the slide and carriage part which slides on bed 5 while feed slide 35 slides on part 37. The feed slide 35 carries in addition a worm gear drive 45 for the rod holder 10. A linear drive 36 is disposed on part 37, and is thus part of carriage 4 and its equipment, while being used for advancing feed slide 35 on bed 37.

The carriage 4 can be moved on bed 5 by means of a rod 38 which has one end linked to the rocking arm 34, and in an adjustable position as far as its distance from the swivel or pivot axis of the arm 34 is concerned. This adjustment is needed for adjusting the carriage movement and displacement path to the effective rolling diameter. The other end of rod 38 is linked to part 37 of carriage 4. This way, carriage 4 will be driven and reciprocated in exact phase synchronism and, of course, at the same oscillatory rate as the rolls are being driven, because all these parts are linked via rocking arm 34 to crank 7.

Due to the particular contour of the working surface of a pilger roll, the linear speed thereof is not a uniform one for a uniform rotational speed of the rolls. In order to match that non-uniformity to the movement of the blank on the mandrel 9, the linking point of arm 38 on arm 34 may be a variable one during a stroke and cycle but the connection has to be a positive one in each instance. However, a better way to compensate the above-mentioned differential of movement will be described next and concerns the equipment on the carriage 4.

Figure 3:
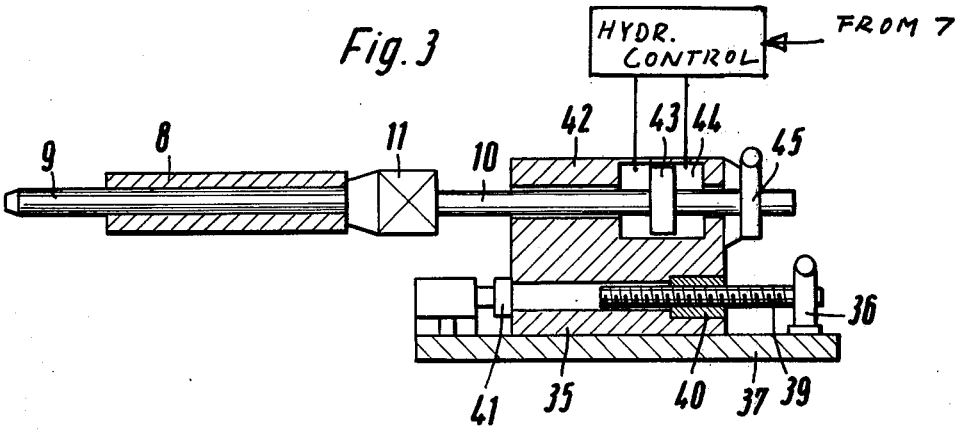
FIG. 3 is a side view showing the mandrel holder on the carriage of the feed mechanism.

FIG. 3 shows the reciprocating carriage 4 in greater detail. Feed slide 35 is moved by a worm gear drive 36 which turns a spindle 39 in a nut 40, the latter being affixed to feed slide 35, so that the slide 35 moves linearly as spindle 39 turns. Movement is impeded and limited by a resiliently yielding bumper 41, being also mounted on bed part 37.

The upper portion of slide 35 is constructed as a hollow guide 42 for the mandrel holder 10. Turning device 45 is provided to turn the holder 10 with mandrel 9 and blank 8 by 90° between passes. Holder 10 carries also a piston 43 being disposed in a piston chamber 44 of guide portion 42. Springs (not shown) may be positioned in chamber 44 and to both sides of piston 43 to center the piston in a middle or neutral position as illustrated. In lieu of springs one may use here a pneumatic cushion to obtain centering of the piston but in a yielding manner. This permits yielding of the mandrel rod for purposes of compensating the speed differences described earlier. The centering action is becoming particularly noticeable on carriage reversal, whereby the rod holder 10 is, in fact, retained in that centering position. Springs or other resilient reaction means, on the other hand, positively take up any play the rod holder would have otherwise.

In lieu of mechanical springs or passive pneumatic cushioning, one may actuate the piston 43 hydraulically. Hydraulic operation alternates depending on the stroke and direction of feeder movement. During rolling piston 43 is urged to move holder 10 in direction opposite to the stand, so that the larger path as defined by the roll contour relative to the carriage path, is compensated. Upon feed advancing, the other side of the piston 43 will be hydraulically biased in the opposite direction and for a displacement thereof, so that the rolls disengage from the hollow 8 and the feeder may now advance by one step, without danger that hollow 8 be upset by the reversing rolls.

Upon reversal of motion of carriage 4, the piston 47 is positioned on one or the other end in cylinder chamber 44. If the carriage reversal does not coincide with the reversal of the rolls but while the rolls still engage the blank, one may obtain a follower motion between them by hydraulic control in addition to the aforementioned stroke difference compensation, to shift rolling power and reaction as between the carriage and the rolls. The control of hydraulic actuation can be derived from drive 6, crank 7 or any associated part that undergoes a precisely defined reciprocating, oscillatory, or other periodic movement.

In operation, the pilger roll stand will be prepared first in the usual manner including placing a hollow 8 onto mandrel rod 9. Carriage 4 is placed into closest position to the stand, which, of course, is a position in which later the carriage movement is being reversed. Spindel 39 is adjusted so that holder 10 positions blank 8 as carried by the rod 9 in the requisite position vis-a-vis the rolls for the first pass.

Following the initialization and preparation procedure, the drive 6 starts. As the rolls turn in that, e.g. upper roll 2 turns left as seen in FIG. 1, carriage 4 is moved to the right. After that rolling pass, and after each subsequent rolling pass, e.g. during feeder advance or even after advance, and upon reversal of the rolls, the blank is turned by 90° by operation of drive 45, and the feeder advances by one step for and commensurate with the next pass.

After the blank 8 has been rolled, except for the end portion, called the pilger head, as that end portion is not engaged by the rolls, drive 6 is stopped and the rolls 2 and 3 are vented. For this, mounts 12 and 12' are lifted by the devices 32 and 33 and the rolled tube is pulled out. As roll 2 is lifted with its bearings, shaft 14 and segments 16 are likewise lifted and rod 25 will assume an oblique disposition. Pinion 22 remains engaged with gear 18.

After another blank has been placed onto the mandrel rod, roll 2 and appended equipment are returned, i.e. mounts 12 and 12' are replaced on the shims 30 and 31, the operating position for the upper roll has been restored. Due to the fact that the roll actuating and moving device and mechanism remained engaged, rolls 2 and 3 will retain the exact position to each other and in relation to the carriage 4, so that a new cycle can begin without readjustment.

The invention is not limited to the embodiments described above but all changes and modifications thereof not constituting departures from the spirit and scope of the invention are intended to be included. I claim:

1. Hot rolling mill stand of the pilger variety comprising:

upper and lower bearing and roll mount means being displaceable in relation to each other transversely to a direction of rolling;

upper and lower pilger rolls respectively journalled in the bearing and roll mount means;

first and second pinion means respectively drivingly connected to the upper roll and the lower roll;

first and second segment gears respectively meshing the first and second pinion means and being pivotally mounted respectively on the upper and lower bearing means;

a drive; means for drivingly linking the drive to the first and second segment gears for imparting upon them and through them upon the rolls oscillatory movement;

a feeder with mandrel rod for carrying and positioning a blank; and means for linking the feeder to the drive to reciprocate in synchronism with the oscillatory movement of the rolls.

2. The rolling mill as in claim 1, the segment gears being internal gears.

3. The rolling mill as in claim 1, the means for linking the drive to the segments including a pair of rods being reciprocated by the drive, the means for linking the feeder including a rocking arm linked to the drive, further including a rod for linking the rocking arm to the feeder.

4. The rolling mill as in claim 3, the rod being linked to the rocking arm by means being adjustable relative to a pivot point of the rocking arm.

5. The rolling mill as in claim 1, said feeder including a carriage carrying a mandrel rod holder for holding the mandrel rod, the mandrel rod holder being axially displaceably mounted on the feeder carriage.

6. The rolling mill as in claim 5, and including drive means for moving the mandrel rod holder for a limited displacement path for purposes of compensating differences between linear roller movement and feeder carriage movement.

7. Hot rolling mill of the pilger variety and having a stand, comprising:

upper and lower bearing means in the stand;

upper and lower pilger rolls respectively journalled in the bearing means;

the upper bearing means and the upper roll being disposed for permitting lifting for venting;

drive means for the rolls, including gear means connected to the rolls for driving them in synchronism with each other and retaining driving engagement during said lifting;

a feeder carriage coupled to said drive means for reciprocating motion in synchronism with the roll driving;

a feed slide on the carriage;

a mandrel rod holder on the feed slide; and means for displaceably positioning the mandrel rod holder on the feed slide.

8. Rolling mill as in claim 7, the means for positioning including means for resiliently yieldingly centering the mandrel rod holder on the feed slide.

9. Rolling mill as in claim 7, the means for positioning including a piston cylinder arrangement.

10. Rolling mill as in claim 7, said drive means including segment gears pivoted on the bearing means and meshing with pinions on the rolls, and means for oscillatorily driving the segment gears.

* * * * *